US008197039B2

(12) United States Patent
Inoue

(10) Patent No.: US 8,197,039 B2
(45) Date of Patent: Jun. 12, 2012

(54) LIQUID EJECTING DEVICE, PRINTING APPARATUS AND LIQUID SUPPLYING METHOD

(75) Inventor: Ken Inoue, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 420 days.

(21) Appl. No.: 12/334,023

(22) Filed: Dec. 12, 2008

(65) Prior Publication Data

US 2009/0153632 A1 Jun. 18, 2009

(30) Foreign Application Priority Data

Dec. 12, 2007 (JP) ..... 2007-321413

(51) Int. Cl.
*B41J 2/175* (2006.01)
*B41J 2/195* (2006.01)

(52) U.S. Cl. ..... 347/85; 347/7; 347/86

(58) Field of Classification Search ..... 347/7, 85, 347/86

See application file for complete search history.

(56) References Cited

U.S. PATENT DOCUMENTS

| | | | | |
|---|---|---|---|---|
| 4,623,905 | A | 11/1986 | Ichihashi et al. | |
| 6,378,971 | B1 | 4/2002 | Tamura et al. | |
| 6,582,068 | B2 | 6/2003 | Ishizawa et al. | |
| 6,758,556 | B2 | 7/2004 | Ishizawa et al. | |
| 6,796,627 | B2 | 9/2004 | Kimura et al. | |
| 6,834,945 | B2 | 12/2004 | Ishizawa et al. | |
| 6,874,876 | B2 | 4/2005 | Ishizawa et al. | |
| 7,152,965 | B2 | 12/2006 | Ishizawa et al. | |
| 7,380,909 | B2 | 6/2008 | Ishizawa et al. | |
| 7,926,924 | B2 * | 4/2011 | Umeda | 347/85 |
| 2007/0195140 | A1 | 8/2007 | Ishizawa et al. | |
| 2007/0279462 | A1 | 12/2007 | Ishizawa et al. | |
| 2008/0204523 | A1 | 8/2008 | Umeda | |
| 2008/0239034 | A1 | 10/2008 | Umeda | |

FOREIGN PATENT DOCUMENTS

| | | | |
|---|---|---|---|
| EP | 0 891 866 | A2 | 1/1999 |
| EP | 1 356 946 | A1 | 10/2003 |
| JP | 06171099 | A | 6/1994 |
| JP | 2001270133 | A | 10/2001 |
| JP | 2007-160639 | * | 6/2007 |
| JP | 2007160639 | A | 6/2007 |

OTHER PUBLICATIONS

European Search Report dated Mar. 20, 2009.

* cited by examiner

*Primary Examiner* — Geoffrey Mruk

(74) *Attorney, Agent, or Firm* — Nutter McClennen & Fish LLP; John J. Penny, Jr.; Christina M. Sperry

(57) ABSTRACT

A liquid ejecting device is provided. A main tank stores liquid. A sub-tank includes a variable volume liquid chamber that stores the liquid supplied from the main tank. A head ejects the liquid supplied from the sub-tank. A carriage is movable to reciprocate the sub-tank and the head. A first engagement member is provided in the sub-tank and is movable to expand the volume of the liquid chamber. A second engagement member engages with the first engagement member and moves the first engagement member. The liquid is supplied from the main tank to the sub-tank when the first engagement member is moved by the second engagement member to expand the volume of the liquid chamber.

11 Claims, 8 Drawing Sheets

LIQUID EJECTING DEVICE, PRINTING APPARATUS AND LIQUID SUPPLYING METHOD

Priority is claimed to Japanese Patent Application No. 2007-321413 filed Dec. 12, 2007, the disclosure of which, including the specification, drawings and claims, is incorporated herein by reference in its entirety.

BACKGROUND

The present invention relates to a liquid ejecting device, a printing apparatus and a liquid supplying method capable of supplying a liquid stored in a main tank to a head through a sub-tank.

As a liquid ejecting device, there is known a device that is mounted in a printer connected to a personal computer or the like and supplies ink as liquid to a print head.

Such a liquid ejecting device includes a sub-tank unit that is mounted in a carriage and receives the ink in an ink storage chamber through an ink supply tube from an ink cartridge to supply the ink stored in the ink storage chamber to a print head at print time; a pump unit that supplies the ink of the ink cartridge to the sub-tank unit; and a pump control unit that controls an amount of the ink in response to a driving signal transmitted to the print head (for example, see Patent Document 1).

However, the pump unit has a complicated structure and needs a large installation space. In order to achieve a simplified and miniaturized structure, an ink supplying device that supplies ink using a driving force of reciprocation motion of a carriage is known (for example, see Patent Document 2).

As disclosed in Patent Document 2, the ink supplying device includes a carriage that reciprocates, an ink cartridge that stores the ink to be supplied to an ink jet print head equipped in the carriage, and an ink storage unit that stores the ink to be consumed upon performing printing by the ink jet print head. In addition, the ink supplying device further includes an ink pump unit that supplies the ink to the ink storage unit when compressed by movement of the carriage toward a predetermined position and sucks the ink from the ink cartridge when restored by movement of the carriage toward a position out of the predetermined position.

Patent Document 1: Japanese Patent Publication No. 2001-270133 A

Patent Document 2: Japanese Patent Publication No. 2007-160639 A

However, the ink supplying device that compresses the ink pump unit with the driving force of the reciprocation motion of the carriage includes the ink storage unit that is a separate tank as a buffer for storing the ink supplied from the ink pump unit. Therefore, a problem occurs in that the size and cost of the ink supplying device may increase.

SUMMARY

It is therefore an object of at least one embodiment of the invention to provide a liquid ejecting device, a printing apparatus and a liquid supplying method capable of miniaturization and low cost.

According to an aspect of at least one embodiment of the invention, there is provided a liquid ejecting device comprising: a main tank that stores liquid; a sub-tank including a variable volume liquid chamber that stores the liquid supplied from the main tank; a head that ejects the liquid supplied from the sub-tank; a carriage that is movable to reciprocate the sub-tank and the head; a first engagement member that is provided in the sub-tank and is movable to expand the volume of the liquid chamber; and a second engagement member that engages with the first engagement member and moves the first engagement member, wherein the liquid is supplied from the main tank to the sub-tank when the first engagement member is moved by the second engagement member to expand the volume of the liquid chamber. The first engagement member may be provided in a main body that reciprocatably supports the carriage.

With this configuration, the liquid chamber is expanded to suck the liquid from the main tank and supply the liquid to the sub-tank, when the carriage is moved and thus the second engagement member moves the first engagement member. Therefore, a separate tank as a buffer for storing the liquid supplied from the sub-tank when compressing the sub-tank is not necessary, compared to a structure in which the sub-tank is compressed and expanded by a spring to suck the liquid from the main tank and then the sub-tank is compressed to supply the liquid. Accordingly, the liquid ejecting device can be miniaturized and thus low cost can be achieved.

The second engagement member may be disposed to engage with the first engagement member when the carriage is out of a printable area, since a variation in movement load of the carriage degrades a print quality.

At least a part of the liquid chamber may be formed of a flexible film. Accordingly, the structure of the liquid ejecting device is simplified and low cost is achieved.

The first engagement member may be provided in a liquid chamber forming member that is deformable to vary the volume of the liquid chamber.

The first engagement member may include a ring; the second engagement member may include a bar; and as the carriage moves in one movement direction, the bar may be inserted into the ring and the ring may be moved along the bar to expand the volume of the liquid chamber. The bar may be inclined with respect to the one movement direction of the carriage so that the ring is moved to expand the volume of the liquid chamber as the carriage moves in the one movement direction.

With the above configuration, as the carriage moves in the one movement direction, the ring is smoothly displaced along the bar to expand the liquid chamber, thereby sucking the liquid from the main tank.

The first engagement member may include a lever that is rotatable about an axis perpendicular to one movement direction of the carriage; and when the carriage moves in the one movement direction, the lever is rotated by the second engagement member to expand the volume of the liquid chamber. The second engagement member may be provided along the one movement direction of the carriage. At least a part of the liquid chamber may be formed of a flexible film.

With the above configuration, when the carriage moves in the one movement direction, the lever is rotated smoothly to expand the volume of the liquid chamber, thereby sucking the liquid from the main tank.

The sub-tank may be integrally provided above the head.

Therefore, the liquid can be supplied from the sub-tank to the head using a water head difference. Moreover, a space above the head can be effectively used for disposing the sub-tank.

According to another aspect of at least one embodiment of the invention, there is also provided a printing apparatus for printing on a medium by ejecting ink from the above head onto the medium, the printing apparatus comprising the above liquid ejecting device that supplies the ink to the head.

With this configuration, a separate tank as a buffer for storing the liquid supplied from the sub-tank when compressing the sub-tank is not necessary. Accordingly, the printing apparatus can be miniaturized and thus low cost can be achieved.

According to another aspect of at least one embodiment of the invention, there is also provided a method of supplying liquid in a liquid supplying apparatus having a reciprocating movable element, comprising: providing a deformable chamber for storing liquid; attaching a first engagement member to the movable element and the deformable chamber; attaching a second engagement member on a fixed portion of the liquid supplying apparatus to engage with the first engagement member and to move the first engagement member; and supplying a liquid to the deformable chamber when the first engagement member is moved by the second engagement member to expand the volume of the deformable chamber.

The first engagement member may include a ring; the second engagement member may include a bar; and as the movable element moves in one movement direction, the bar is inserted into the ring and the ring may be moved along the bar to expand the volume of the deformable chamber.

The first engagement member may include a lever that is rotatable about an axis perpendicular to one movement direction of the movable element; and when the movable element moves in the one movement direction, the lever is rotated by the second engagement member to expand the volume of the deformable chamber.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Hereinafter, a liquid ejecting device and a printing apparatus will be described with reference to the drawings according to an embodiment of the invention.

First, the structure of the ink jet printer as a printing apparatus of the embodiment will be described.

Figure 1:
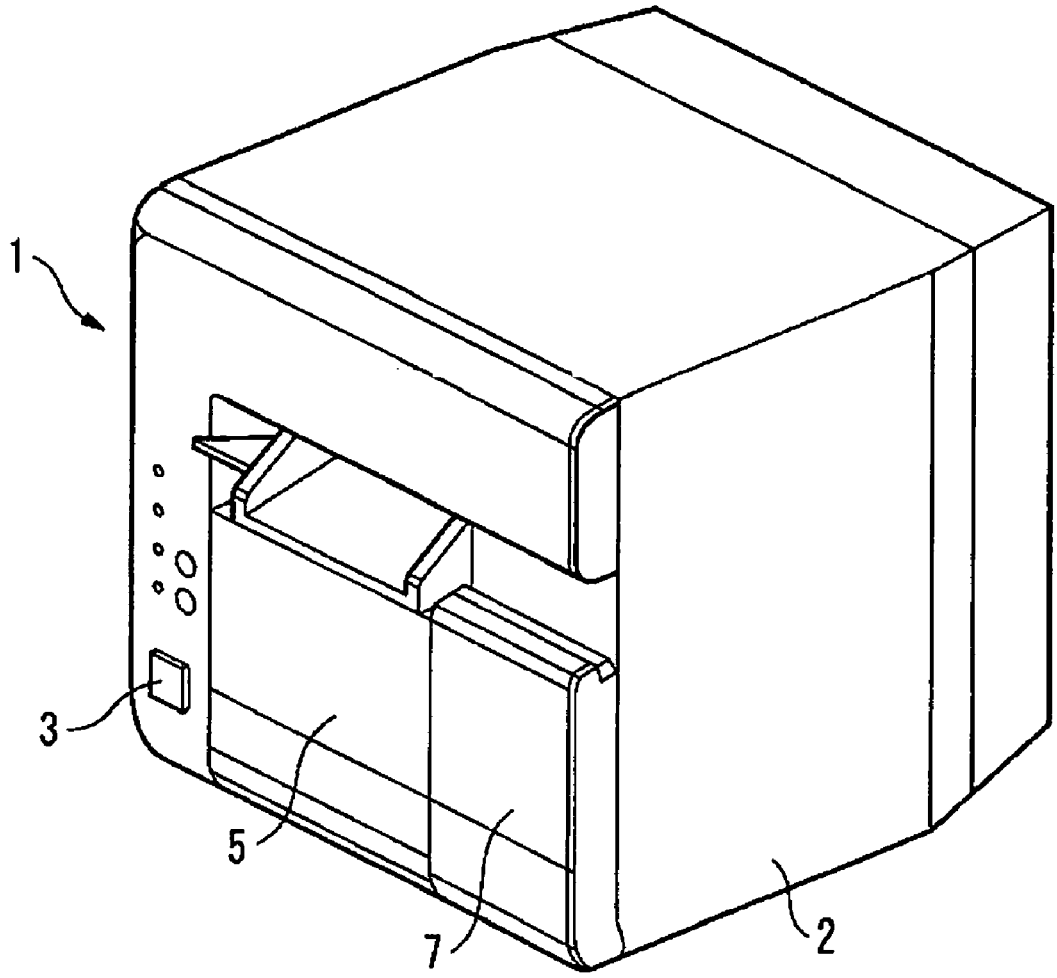
FIG. 1 is a perspective view illustrating an ink jet printer according to an exemplary embodiment of the invention.

As shown in FIG. 1, an ink jet printer 1, which can perform color printing on a roll sheet using a plurality of color ink types, is provided with a roll sheet cover 5 and an ink cartridge cover 7, which can be opened, at a front face of a printer case 2 covering a printer body. In addition, a power switch 3, a feed switch, an indicator, and the like may be disposed on the front face of the printer case 2.

Figure 2:
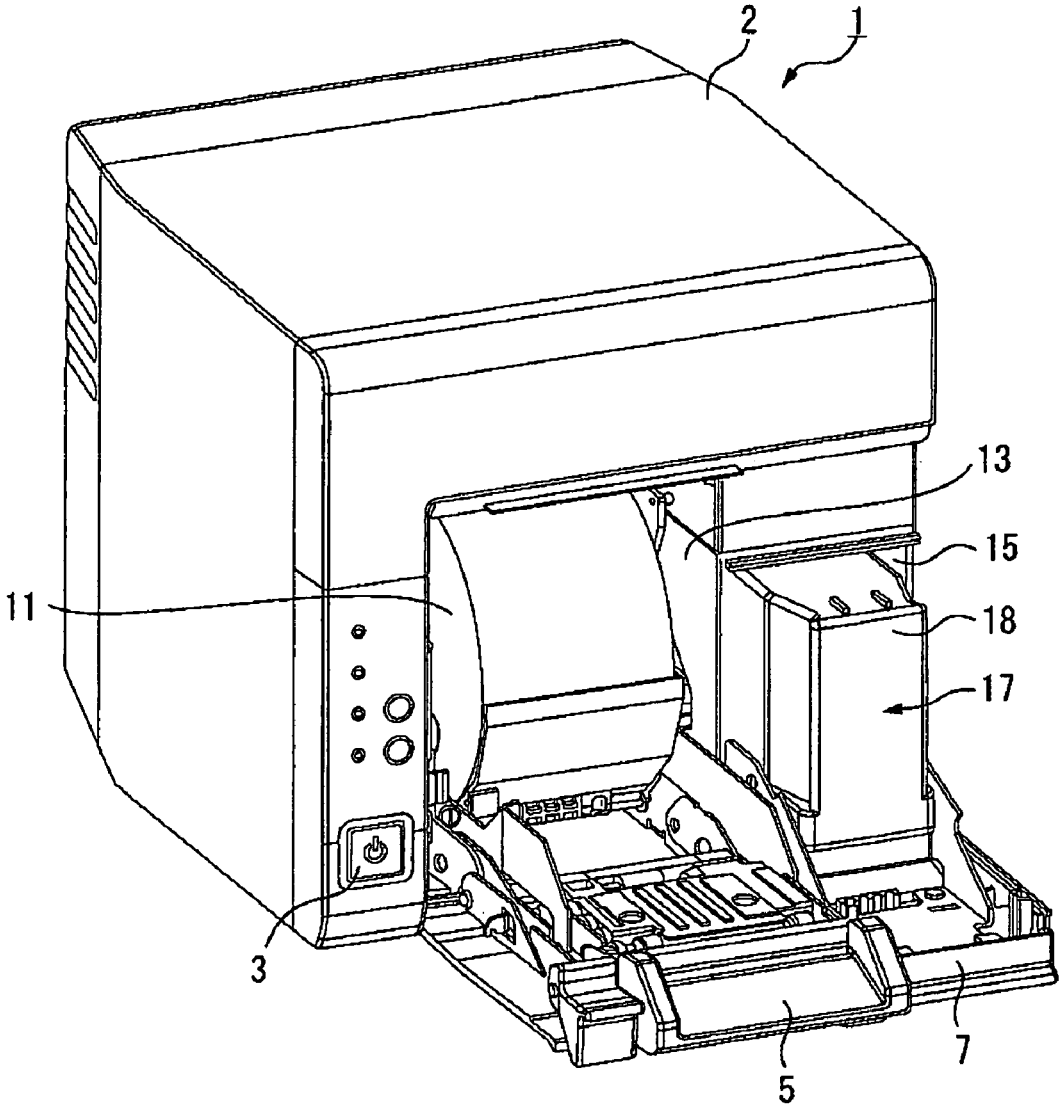
FIG. 2 is a perspective view illustrating the ink jet printer shown in FIG. 1 when a printer cover is opened.

In FIG. 2, when the roll sheet cover 5 is opened, a sheet receiving unit 13 that receives a roll sheet 11 as a print medium enters an open state to allow exchange of the roll sheet 11.

When the ink cartridge cover 7 is opened, a cartridge mount unit 15 enters an open state so that an ink cartridge (main tank) 17 may be detachably mounted on the cartridge mount unit 15.

In this case, in conjunction with the opening of the ink cartridge cover 7, the ink cartridge 17 is drawn by a predetermined distance toward a front side of the cartridge mount unit 15.

Figure 3:
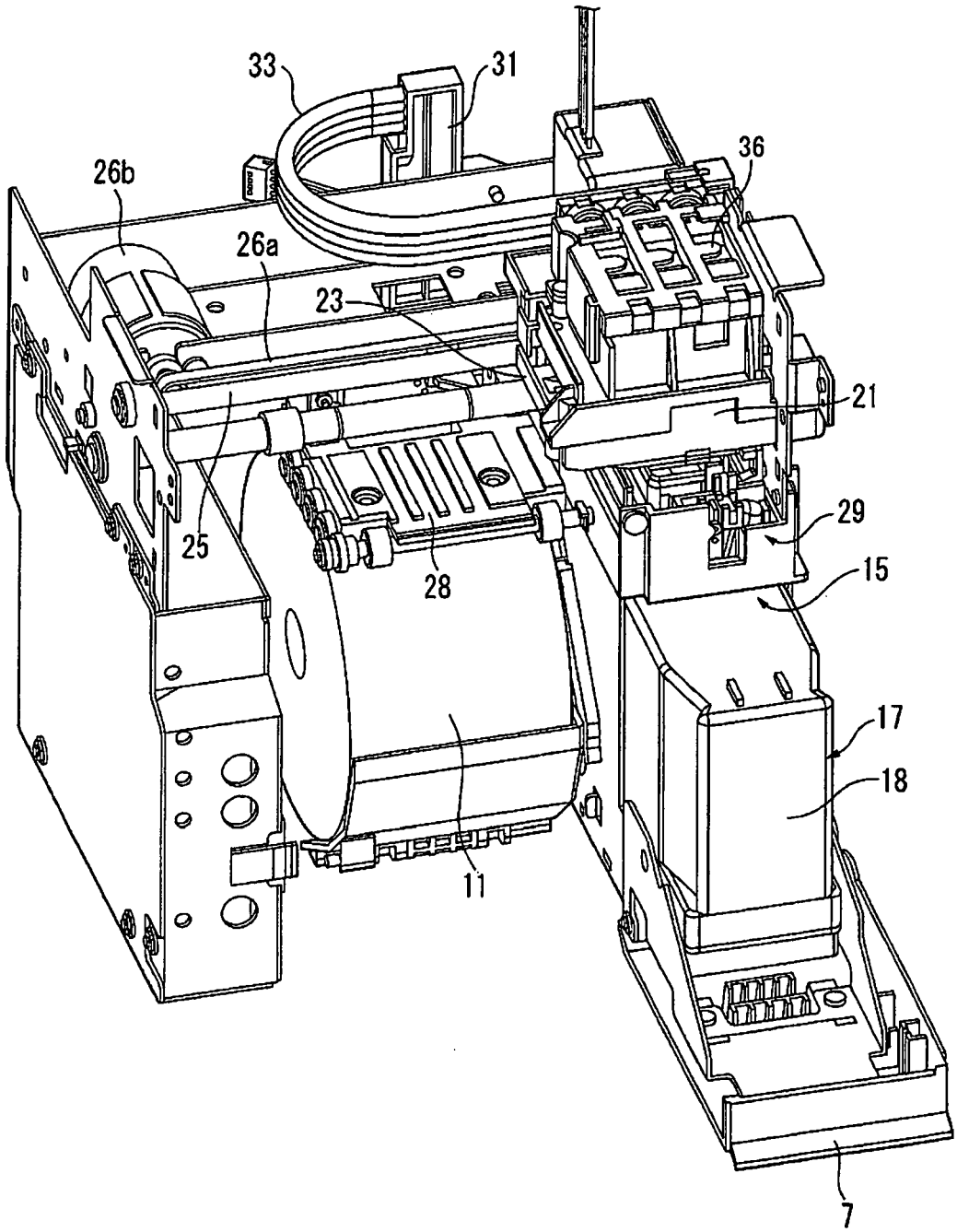
FIG. 3 is a perspective view illustrating the ink jet printer shown in FIG. 1 when a printer case is removed.
Figure 4:
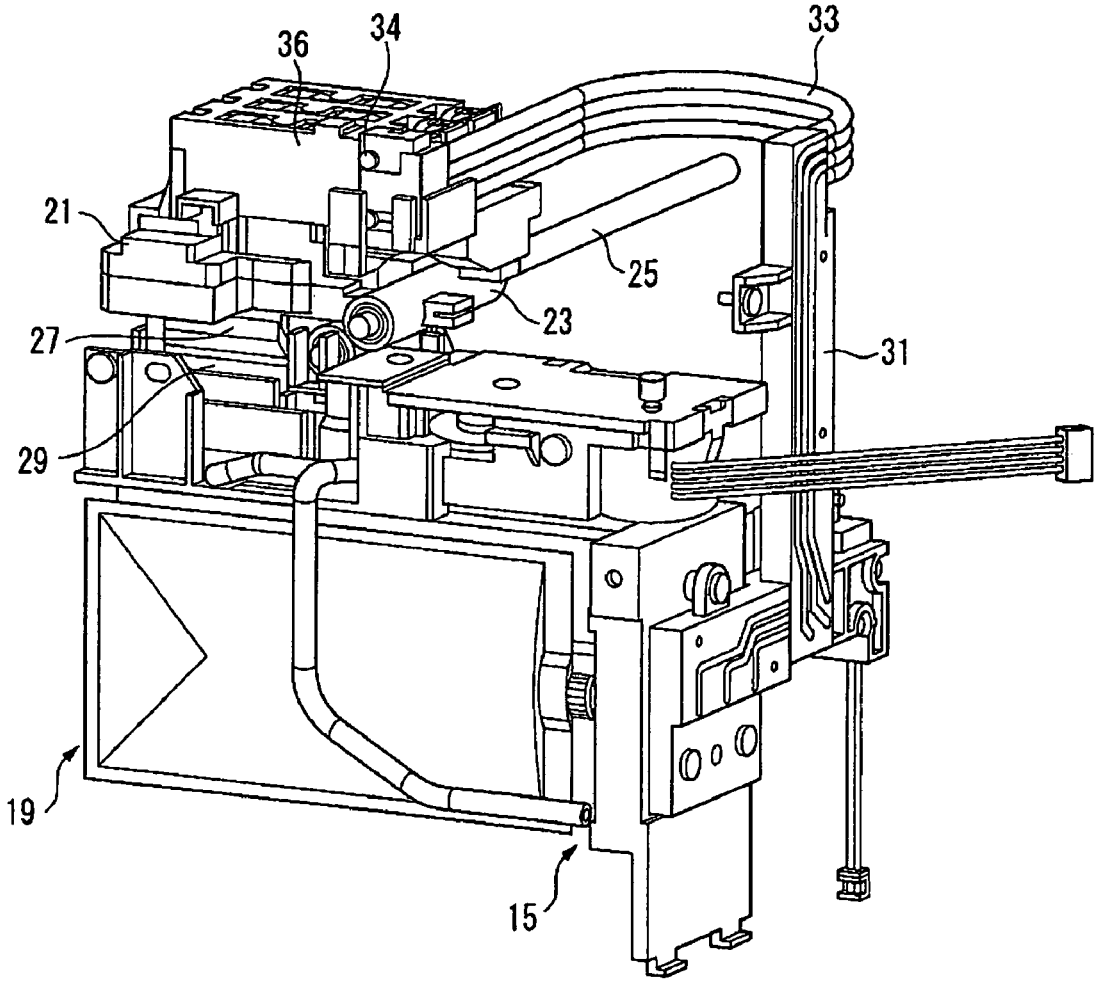
FIG. 4 is a perspective view illustrating a connection structure of constituent elements from an ink cartridge to an ink jet head on a carriage in the ink jet printer shown in FIG. 1.

As shown in FIGS. 3 and 4, a carriage 23 equipped with an ink jet head (head) 21 is provided above the sheet receiving unit 13 within the printer case 2. The carriage 23 is movably supported in a width direction of the roll sheet by a guide member 25 that extends in the width direction of the roll sheet 11. The carriage 23 can reciprocate in the width direction of the roll sheet 11 above a platen 28 by an endless belt **26*a* that extends in the width direction of the roll sheet 11 and a carriage motor 26*b* that drives the endless belt 26*a***.

As shown in FIG. 3, the upper position of the cartridge mount unit 15 is a standby position (home position) of the carriage 23. In addition, below the standby position, there are provided a cap 27 covering ink nozzles of the ink jet head 21 exposed toward the lower face of the carriage 23 and an ink sucking mechanism 29 for sucking or discharging ink in the ink nozzles of the ink jet head 21 through the cap 27.

Figure 5:
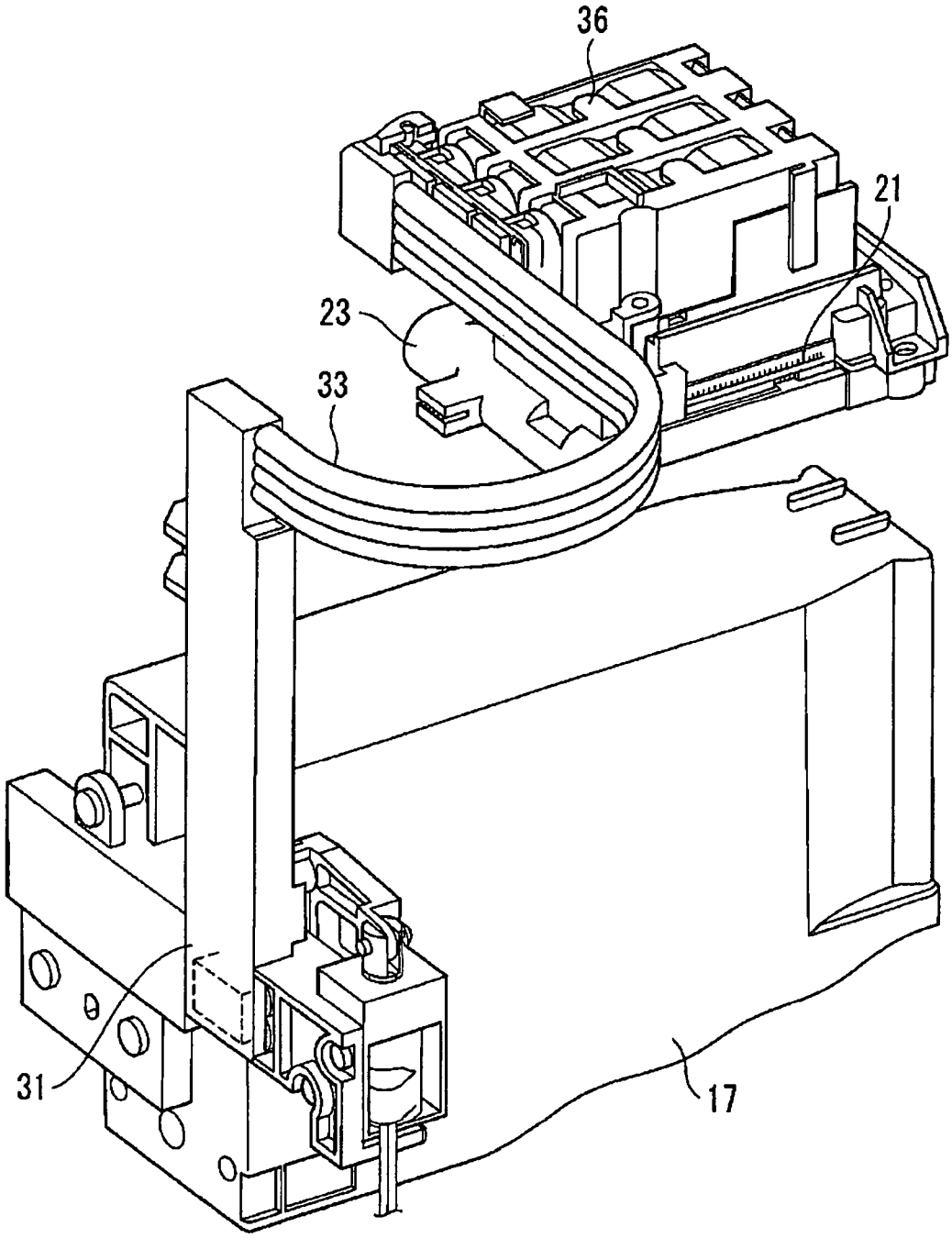
FIG. 5 is a perspective view illustrating the connection structure from the ink cartridge to the ink jet head on the carriage in the ink jet printer shown in FIG. 1 when viewed from a different direction.

The ink cartridge 17 receives plural color ink packs 19 shown in FIG. 4 within the cartridge case 18 shown in FIG. 3. As for each of the ink packs 19 within the ink cartridge 17, an ink supply needle provided in the cartridge mount unit 15 is inserted into an ink supply port of the ink pack 19, when the ink cartridge 17 is mounted on the cartridge mount 15. An ink passage 31 formed within the printer case 2 is connected to the ink supply needle of the cartridge mount unit 15, as shown in FIG. 5. One end of each of flexible ink supply tubes 33 divided in accordance with respective colors is connected to the ink passage 31.

The other end of each of the ink supply tubes 33 is connected to each of ink pump units 34 provided on the carriage 23, as shown in FIG. 4. Each of the ink pump units 34 is connected to one of self-sealing units 36 connected to the ink jet head 21.

Figure 6:
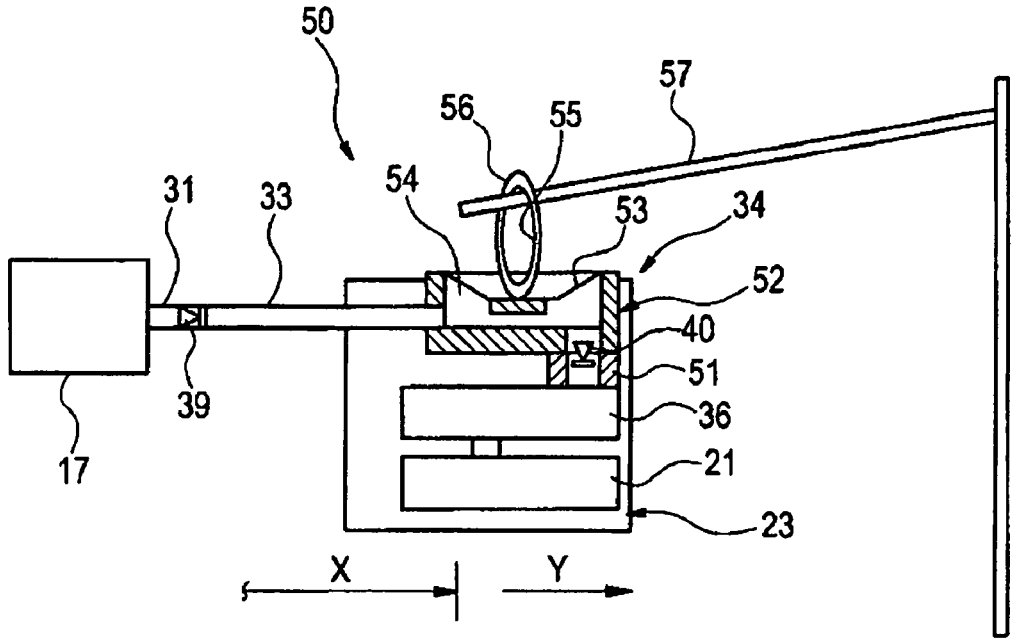
FIG. 6 is a schematic diagram illustrating an example of an ink supplying mechanism in the ink jet printer shown in FIG. 1.

As shown in FIG. 6, the ink pump units 34 and the self-sealing units 36 in addition to the ink jet head 21 are integrally mounted on the carriage 23. Here, FIG. 6 only shows a single-color structure that corresponds to one of the ink pump units and one of the self-sealing units.

With such a configuration, the ink of the respective ink packs 19 within the ink cartridge 17 is each supplied from the ink supply needles of the cartridge mount unit 15 to the respective ink nozzles of the ink jet head 21 through the ink passage 31, the ink supply tubes 33, the ink pump units 34, and the self-sealing units 36 of the respective colors.

Next, an ink supplying mechanism 50 of the ink jet printer 1 will be described with reference to the single-color structure shown in FIG. 6.

A check valve 39 is provided in an end of the ink passage 31 on the side of the ink cartridge 17. Accordingly, between the ink cartridge 17 and the ink pump unit 34, the check valve 39 allows ink to flow from the ink cartridge 17 to the ink pump unit 34 in only one direction.

A check valve 40 is also provided in an ink passage 51 between the ink pump unit 34 and the self-sealing unit 36, so that ink flows from the ink pump unit 34 to the self-sealing unit 36 in only one direction.

As shown in FIG. 6, the so-called on-carriage type ink pump unit 34 mounted in the carriage 23 is provided above the ink jet head 21 and includes a sub-tank 52 communicating with the ink supply tube 33. The sub-tank 52 includes an ink chamber 54 of which an upper portion is covered with a flexible film 53 having a flexible property. A volume of the ink chamber varies with deformation of the flexible film 53. Since the ink chamber 54 communicates with the ink supply tube 33 and the ink passage 51 close to the self-sealing unit 36, the ink is supplied from the ink cartridge 17 and then the ink is supplied to the self-sealing unit 36. The flexible film 53 is made of a flexible material such as rubber, elastomer, or a resin film that is easily deformed. Accordingly, the swell or contraction of the flexible film 53 causes the volume of the ink chamber 54 to be expanded or reduced. A ring-shaped engagement member (first engagement member) 56 having a vertically long insertion hole (long hole) 55 is fixed to the upper center portion of the flexible film 53. The flexible film 53 is deformed to be swollen or contracted when the engagement member 56 is displaced upward or downward.

Above a movement path of the sub-tank 52 that moves together with the carriage 23, an engagement bar (second engagement member) 57 is supported along a movement direction of the carriage on one side of a home position. The home position corresponds to an area outside of a printable area X of the ink jet head 21. The engagement bar 57 is inclined upward away from the sub-tank 52 in a Y direction away from the printable area X. A front end of the engagement bar 57 is located lower than the upper end of the insertion hole 55 of the engagement member 56 that has moved down with the contraction of the flexible film 53, when the ink jet head 21 has moved outside of the home position.

Figure 7:
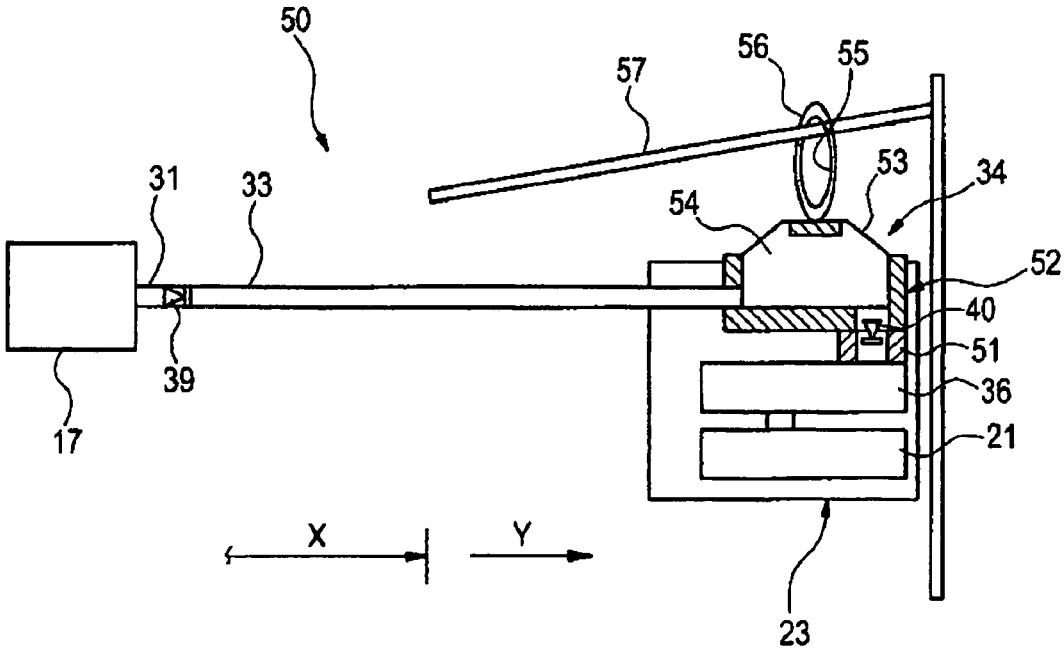
FIG. 7 is a schematic diagram illustrating operations of the ink supplying mechanism shown in FIG. 6.

The front end of the engagement bar 57 is inserted into the insertion hole 55 of the engagement member 56, when the sub-tank 52 moves away from the printable area X in the Y direction toward the home position. Then, as shown in FIG. 7, the engagement bar 57 is brought into contact with the upper end of the insertion hole 55 of the engagement member 56 so that the engagement member 56 is moved up along the inclination of the engagement bar 57.

In this way, since the flexible film 53 of the ink pump unit 34 is pulled and deformed by the engagement member 56 to be swollen, the ink chamber 54 of the sub-tank 52 is expanded, thereby increasing the volume of the ink chamber 54.

That is, when the engagement member 56 is pulled by the engagement bar 57, the flexible film 53 is swollen, the volume of the ink chamber 54 is increased. Then, the check valve 39 is opened and the ink is sucked from the ink cartridge 17 to the ink chamber 54 through the ink passage 31 and the ink supply tube 33.

In this state, the engagement of the engagement member 56 with the engagement bar 57 is released when the carriage 23 moves toward the printable area X, which is a direction opposite to the Y direction. Then, the ink is ejected from the ink jet head 21 when the ink is supplied from the self-sealing unit 36 to the ink jet head 21. In addition, since the inside of the self-sealing unit 36 is negative-pressurized, the check valve 40 is opened and then the ink is supplied from the ink chamber 54 to the self-sealing unit 36 through the ink passage 51.

Figure 8:
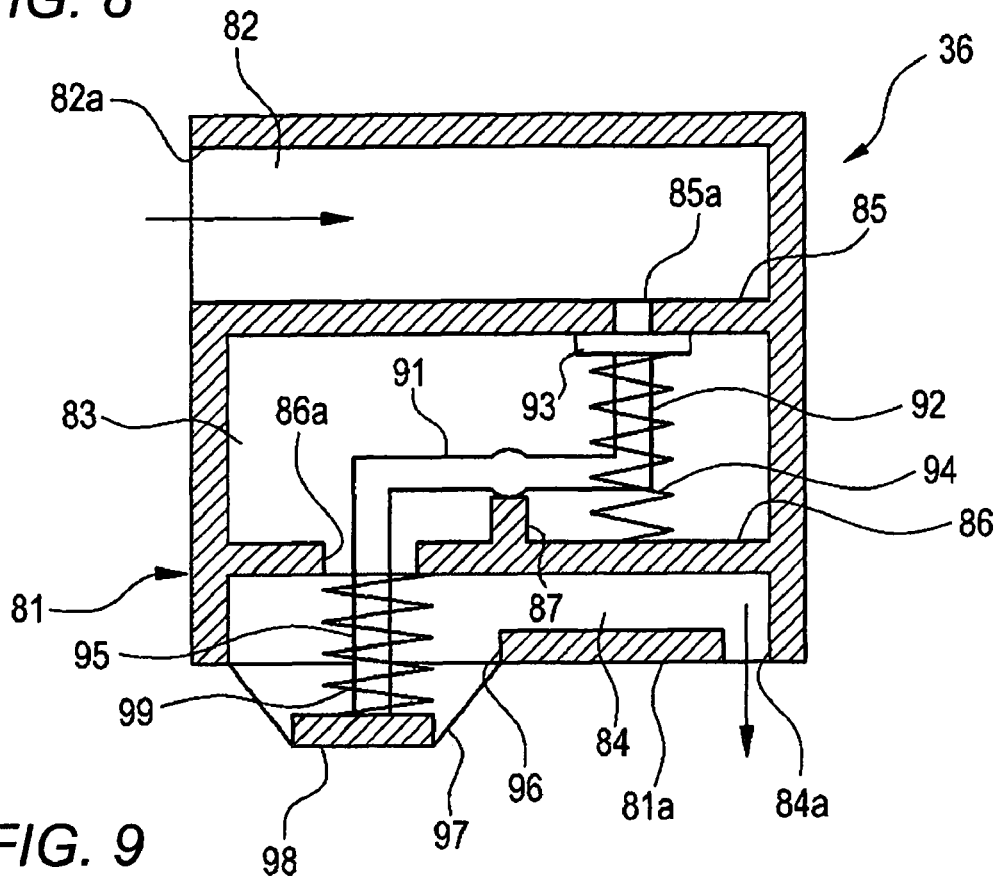
FIG. 8 is a sectional view illustrating the structure of a self-sealing unit in the ink jet printer shown in FIG. 1.

As shown in FIG. 8, the self-sealing unit 36 includes a unit main body 81 that is provided with a supply passage 82, an intermediate passage 83, and a discharge passage 84. In addition, an end portion on the downstream side of the ink passage 51 is connected to a supply port 82*a* formed in the supply passage 82 and the ink jet head 21 is connected to a discharge port 84*a* formed in the discharge passage 84.

An inflow port 85*a* is formed in a wall portion 85 partitioning the supply passage 82 and the intermediate passage 83, and thus the ink flows from the supply passage 82 to the intermediate passage 83 through the inflow port 85*a*. In addition, a communication port 86*a* is formed in a wall portion 86 partitioning the intermediate passage 83 and the discharge passage 84, and thus the ink flows from the intermediate passage 83 to the discharge passage 84 through the communication port 86*a*.

Within the intermediate passage 83, a supporting point portion 87 is formed in the wall portion 86. A pivotal bar 91 is pivotably supported by the supporting point portion 87. An operation bar portion 92 bent toward the wall portion 85 is integrally formed in one end of the pivotal bar 91 and a closure plate 93 for coming in contact with the wall portion 85 to close the inflow port 85*a* is formed in a front end of the operation bar portion 92. A compression spring 94 is provided between the closure plate 93 and the wall portion 86. The closure plate 93 is urged toward the wall portion 85 by an urging force of the compression spring 94. A pressing bar portion 95 bent toward the wall portion 86 and inserted into the communication port 86*a* of the wall portion 86 is formed in the other end of the pivotal bar 91.

An opening 96 is formed in a side wall 81*a* of the discharge passage 84 of the unit main body 81. In the opening 96, a film 97 having a liquid-tight property and a flexible property is liquid-tightly connected to an edge of the opening 96. A pressing plate 98 is fixed to the center portion of the film 97 on a side of the discharge passage 84. A front end of the pressing bar portion 95 of the pivotal bar 91 comes in contact to the pressing plate 98. A compression spring 99 is provided between the pressing plate 98 and the wall portion 86, and thus the pressing plate 98 is bulged outward by an urging force of the compression spring 99. In the self-sealing unit 36, the closure plate 93 is pressed against the wall portion 85 by a pressure applying to the compression spring 94 and the closure plate 93, so that the inflow port 85*a* is closed.

In the self-sealing unit 36, the closure plate 93 moves away from the wall portion 85 by pivot of the pivotal bar 91 about the connection position of the supporting point portion 87, when the pressing bar portion 95 of the pivotal bar 91 is pressed by the pressing plate 98 with a decrease in the volume of a portion covered with the film 97. In this way, the ink flows into the intermediate passage 83 and the discharge passage 84 through the supply passage 82 and the inflow port 85*a* and the ink is supplied to the ink jet head 21.

By providing the self-sealing unit 36 on an upstream side of the ink jet head 21, it is possible to prevent a variation in a pressure of the ink from being delivered toward the ink jet head 21 by the self-sealing unit 36, even when the variation in the pressure of the ink in a supply side occurs due to an increase or decrease in the moving speed of the carriage 23, for example.

Accordingly, it is possible to prevent a problem such as dot omission caused by undesired ink ejection, ink leakage, or ejection failure of the ink jet head 21, which may occur in the delivery of the variation in the pressure.

According to the ink supplying mechanism 50 and the ink jet printer 1 described above according to the embodiment, when the carriage 23 moves in the Y direction away from the printable area X, the engagement member 56 engages with the engagement bar 57 and thus the flexible film 53 is pulled and deformed to expand the volume of the ink chamber 54, thereby sucking the ink from the ink cartridge 17 to supply the ink. Accordingly, it is no longer necessary to provide a separate tank as a buffer storing the ink supplied from the sub-tank by compressing the sub-tank, compared to a structure in which a compressed sub-tank is expanded by a spring to suck liquid from a main tank and the sub-tank is further compressed to supply the ink, for example. As a result, the ink supplying mechanism 50 is miniaturized, and low cost can be achieved. Moreover, the ink remaining in the ink cartridge 17 can be consumed nearly completely.

The ink can be supplied from the sub-tank 52 to the ink jet head 21 using a liquid level difference, since the sub-tank 52 is provided above the ink jet head 21. Moreover, the sub-tank 52 may be effectively disposed in a space above the ink jet head 21 on the carriage 23, thereby further achieving the miniaturization.

Figure 9:
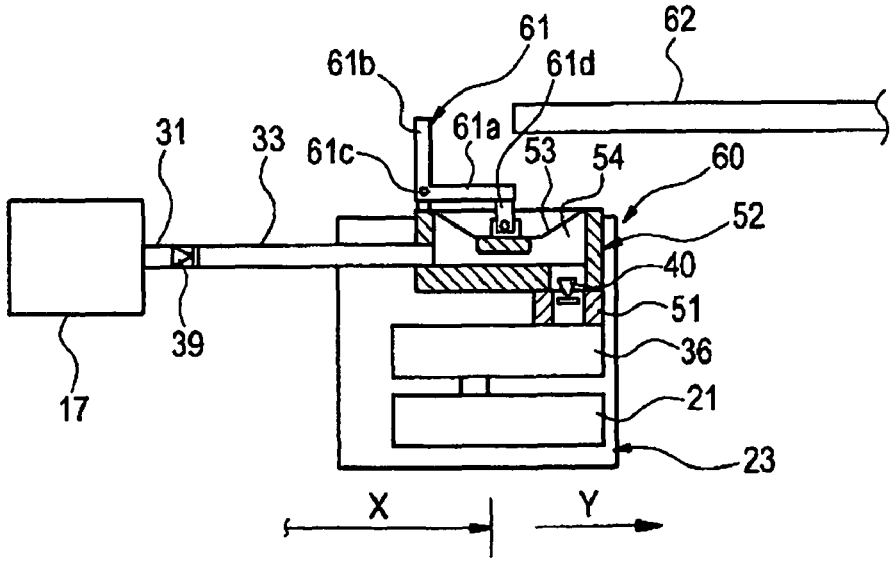
FIG. 9 is a schematic diagram illustrating another example of the ink supplying mechanism in the ink jet printer shown in FIG. 1.

According to another embodiment, as shown in FIG. 9, the sub-tank 52 includes a lever (first engagement member) 61 having an L shape in side view. The lever 61 includes an operation portion 61*a*, a pressed portion 61*b* and a corner portion 61*c*. A corner portion 61*c* is rotatable about an axis perpendicular to the movement direction of the carriage and is connected to the edge of the sub-tank 52 at a side of the printable area X. The operation portion 61*a* has a connection portion 61*d* protruding downward. The end of the connection portion 61*d* is rotatable about the axis perpendicular to the movement direction of the carriage and is connected to the upper center portion of the flexible film 53.

On a movement path of the pressed portion 61*b* of the lever 61 that is provided in the sub-tank 52 movable together with the carriage 23, a pressing plate (a pressing member, a second engagement member) 62 is supported in a home position that corresponds to an area outside of the printable area X of the ink jet head 21.

Figure 10:
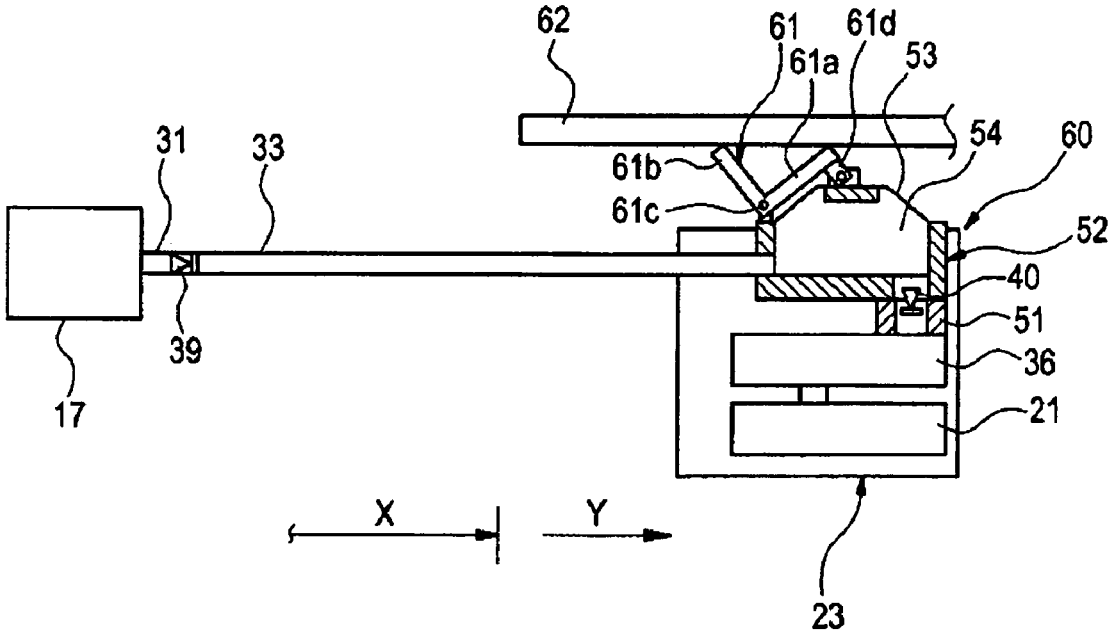
FIG. 10 is a schematic diagram illustrating operations of the ink supplying mechanism shown in FIG. 9.

Accordingly, when the sub-tank 52 moves out of the printable area X and moves toward the home position in the Y direction, the pressing plate 62 comes in contact with the pressed portion 61*b* of the lever 61. Then, when the pressing plate 62 presses the pressed portion 61*b* of the lever 61, the lever 61 rotates about the corner portion 61*c* that is a connection portion with the sub-tank 52, as shown in FIG. 10. In this way, the center portion of the flexible film 53 connected to the operation portion 61*a* of the lever 61 is pulled upward by the connection portion 61*d* to be deformed and swollen, so that the ink chamber 54 of the sub-tank 52 is expanded, thereby increasing the volume of the sub-tank 52.

That is, when the lever 61 is pulled, the flexible film 53 is swollen, and thus the volume of the ink chamber 54 is increased, the check valve 39 is opened and thus the ink is sucked from the ink cartridge 17 to the ink chamber 54 through the ink passage 31 and the ink supply tube 33.

In this state, the press of the pressing plate 62 against the pressing portion 61*b* of the lever 61 is released, when the carriage 23 moves toward the printable area X, which is a direction opposite to the Y direction. Then, the ink is ejected from the ink jet head 21, when the ink is supplied from the self-sealing unit 36 to the ink jet head 21. The ink is supplied from the ink chamber 54 to the self-sealing unit 36 through the ink passage 51 while the check valve 40 is opened due to the negative pressure within the self-sealing unit 36.

Even with such a configuration, when the carriage 23 moves in the Y direction as the one direction getting away from the printable area X, the lever 61 smoothly rotates and the flexible film 53 is pulled to expand the volume of the ink chamber 54, thereby sucking the ink from the ink cartridge 17 to supply the ink. Accordingly, it is no longer necessary to provide the separate tank as the buffer storing the ink supplied from the sub-tank when compressing the sub-tank, compared to the structure in which the compressed sub-tank is expanded by the spring to suck liquid from the main tank and the sub-tank is further compressed to supply the ink, for example. As a result, the ink supplying mechanism is miniaturized, and low cost can be achieved. Moreover, the ink remaining in the ink cartridge 17 can be consumed almost completely.

In addition to the ink jet type printer described in the above-described embodiment, the liquid ejecting device according to the invention is applicable to a liquid supplying apparatus that supplies liquid to a liquid ejecting head such as a color material ejecting head used to manufacture a color filter such as a liquid crystal display or an organic EL display, an electrode material ejecting head used to form electrodes such as a field emission display (FED), and a bio-organism ejecting head used to manufacture a bio chip. The liquid ejecting device according to the invention is also applicable to a liquid supplying apparatus to supply liquid to a sample ejecting apparatus as a precise pipette, and the like.

Examples of the liquid include gel liquid, liquid having high viscosity, liquid mixed with a solid solvent, water-based ink, and oil-based ink.

What is claimed is:

1. A liquid ejecting device on which a main tank storing liquid is to be detachably mounted, the liquid ejecting device comprising:

a carriage that is configured to be reciprocatable;

a main body reciprocatably supporting the carriage;

a sub-tank mounted on the carriage, the sub-tank including a variable volume liquid chamber that is configured to store the liquid supplied from the main tank;

a head mounted on the carriage and configured to eject the liquid supplied from the sub-tank;

a first engagement member provided on the sub-tank; and a second engagement member provided on the main body and configured to press the first engagement member such that the second engagement member moves the first engagement member relative to the sub-tank so as to expand a volume of the liquid chamber and supply the liquid from the main tank to the sub-tank while the carriage is moving toward a home position of the carriage.

2. The liquid ejecting device as set forth in claim 1, wherein the second engagement member is configured to come in contact with the first engagement member when the carriage, which is moving toward the home position, reaches a position out of an ejecting process area in which the liquid is ejected.

3. The liquid ejecting device as set forth in claim 1, wherein at least a part of the liquid chamber is formed of a flexible film.

4. The liquid ejecting device as set forth in claim 1, wherein the first engagement member is provided on a liquid chamber forming member that is deformable to vary the volume of the liquid chamber.

5. The liquid ejecting device as set forth in claim 1, wherein the first engagement member includes a lever that is configured to rotate about an axis substantially perpendicular to a movement direction of the carriage; and wherein the second engagement member is configured to come in contact with the lever and rotate the lever about the axis so as to expand the volume of the liquid chamber while the carriage is moving toward the home position.

6. The liquid ejecting device as set forth in claim 5, wherein the second engagement member is provided along the movement direction of the carriage.

7. The liquid ejecting device as set forth in claim 5, wherein at least a part of the liquid chamber is formed of a flexible film;

wherein the second engagement member includes a pressing member;

wherein the lever includes an operation portion connected to the flexible film and a pressed portion; and wherein the pressing member is configured to press the pressed portion of the lever so that the operation portion of the lever pulls the flexible film so as to expand the volume of the liquid chamber while the carriage is moving toward the home position.

8. The liquid ejecting device as set forth in claim 1, wherein the sub-tank is provided integral with the head and disposed above the head.

9. A printing apparatus for printing on a medium by ejecting ink from the head as set forth in claim 1 onto the medium, the printing apparatus comprising the liquid ejecting device as set forth in claim 1, that supplies the ink to the head.

10. A liquid ejecting device on which a main tank storing liquid is to be detachably mounted, the liquid ejecting device comprising:

a carriage that is configured to be reciprocatable;

a main body reciprocatably supporting the carriage;

a sub-tank mounted on the carriage, the sub-tank including a variable volume liquid chamber that is configured to store the liquid supplied from the main tank;

a head mounted on the carriage and configured to eject the liquid supplied from the sub-tank;

a first engagement member provided on the sub-tank; and a second engagement member provided on the main body and configured to engage with the first engagement member such that the second engagement member moves the first engagement member relative to the sub-tank so as to expand a volume of the liquid chamber and supply the liquid from the main tank to the sub-tank when the carriage is moved toward a home position of the carriage, wherein the first engagement member includes a ring;

wherein the second engagement member includes a bar; and wherein the bar is configured to be inserted into the ring and move the ring relative to the sub-tank so as to expand the volume of the liquid chamber when the carriage is moved toward the home position.

11. The liquid ejecting device as set forth in claim 10, wherein the bar is inclined with respect to a movement direction of the carriage.

* * * * *